US010894185B2

(12) United States Patent
Curry

(10) Patent No.: US 10,894,185 B2
(45) Date of Patent: Jan. 19, 2021

(54) DETACHABLE TRAINING HOLD

(71) Applicant: Michael M. Curry, Henderson, NV (US)

(72) Inventor: Michael M. Curry, Henderson, NV (US)

( * ) Notice: Subject to any disclaimer, the term of this patent is extended or adjusted under 35 U.S.C. 154(b) by 7 days.

(21) Appl. No.: 16/275,825

(22) Filed: Feb. 14, 2019

(65) Prior Publication Data

US 2019/0247714 A1 Aug. 15, 2019

Related U.S. Application Data

(60) Provisional application No. 62/630,748, filed on Feb. 14, 2018.

(51) Int. Cl.
*A63B 23/16* (2006.01)

(52) U.S. Cl.
CPC ..... *A63B 23/16* (2013.01)

(58) Field of Classification Search
CPC ... A63B 23/16; A63B 21/068; A63B 69/0048; A63B 21/169; A63B 2225/09; A63B 2209/00; A63B 2209/10; A63B 23/00
See application file for complete search history.

(56) References Cited

U.S. PATENT DOCUMENTS

| | | | | |
|---|---|---|---|---|
| 9,302,138 | B2 * | 4/2016 | McCanney | A63B 21/4035 |
| 9,468,805 | B2 * | 10/2016 | White | A63B 23/16 |
| 9,999,802 | B2 * | 6/2018 | Kilmon | A63B 21/1618 |
| 2007/0240281 | A1 * | 10/2007 | Meissner | A63B 69/0048 16/108 |
| 2012/0125148 | A1 * | 5/2012 | Inoue | B62M 3/086 74/594.6 |
| 2012/0329610 | A1 * | 12/2012 | White | A63B 23/16 482/44 |
| 2014/0329651 | A1 * | 11/2014 | Thomason | A63B 21/4035 482/141 |
| 2016/0045778 | A1 * | 2/2016 | Dwork | A63B 23/1227 482/96 |
| 2016/0102805 | A1 * | 4/2016 | Khodapanah | F16M 11/10 248/224.8 |
| 2016/0304156 | A1 * | 10/2016 | Pepito | B62M 3/086 |
| 2017/0252598 | A1 * | 9/2017 | Ross | A63B 21/00065 |
| 2018/0126218 | A1 * | 5/2018 | Curry | A63B 23/16 |
| 2020/0222778 | A1 * | 7/2020 | Smith | A63B 69/0048 |

* cited by examiner

*Primary Examiner* — Andrew S Lo
(74) *Attorney, Agent, or Firm* — Barnes & Thornburg LLP

(57) ABSTRACT

Devices, systems, and methods for finger and/or grip training including detachable hold features for engaging a user's finger to work against a load.

20 Claims, 20 Drawing Sheets

DETACHABLE TRAINING HOLD

CROSS-REFERENCE TO RELATED APPLICATIONS

This application claims the benefit of priority under 35 U.S.C. § 119, to U.S. Provisional Application No. 62/630,748, filed on Feb. 14, 2018, the contents of which are hereby incorporated by reference in their entirety, and including at least those portions related to devices, systems, and methods of training.

BACKGROUND

The present disclosure relates to devices, systems, and methods for fitness training, and more particularly to devices, systems, and methods for finger and/or grip training.

Finger strength and/or stamina can be important to many types of activities, for example, sporting activities. Developing finger strength and/or stamina with particular consideration for conditions of the sporting activity of choice can enhance the effectiveness of finger and/or stamina in the modes particular to the activity. Sporting activities, such as climbing, benefit from particularly developed fingers to enhance the ability of the climber to interact with the climbing surface, for example, rock formations. General grip training can fail to address challenges particular to specific activities, for example, climbing.

SUMMARY

The present disclosure may comprise one or more of the following features and combinations thereof:

A finger training system may include various holds which can be quickly and easily attached and detached from a mounting platform to provide an adaptable training stage. The attachment/detachment of the hold may be achieved according to precise maneuvering of the hold relative to a movable attachment assembly that is secured with the mounting platform, without the use of tools, to provide a highly portable and adjustable system.

According to an aspect of the present disclosure, a finger training device for applying resistance to at least one finger of a user for physical activity may include a mounting platform including a mounting body, an attachment system including a base mount secured with the mounting platform and a latch moveably engaged with the base mount and positionable between a retracted position and an extended position. The finger training device may include at least one hold feature including an engagement surface for engagement with at least one finger of the user's hand. The at least one hold feature may be selectively attachable with the attachment system for securement with the mounting platform. The at least one hold feature may define a mount opening configured for receiving the attachment system therein, the mount opening formed in correspondence with the attachment system to block against removal of the attachment system from the mount opening when the latch is arranged in the extended position and to permit removal of the attachment system from the mount opening when the latch is arranged in the retracted position.

According to another aspect of the present disclosure, a finger training device for transferring training force to at least one finger of a user for physical activity may include a mounting platform including a mounting body, and an attachment system including: a base mount secured with the mounting platform and defining a first cleat surface, and a latch mount positionable between a retracted position and an extended position for selectively securing with training instruments. The latch may define a second cleat surface spaced apart from the first cleat surface. In the extended position a first distance may be defined between the first cleat surface and the second cleat surface. In the retracted position a second distance may be defined between the first cleat surface and the second cleat surface, the first distance being greater than the second distance.

In some embodiments, the first cleat surface may be angled towards the mounting platform. The second cleat surface may be angled towards the mounting platform.

The first cleat surface may be defined on an end of the base mount. The second cleat surface may be defined on an end of the latch mount opposite to the end of the base mount.

In some embodiments, the latch mount may be moveable between the retracted and extended positions in a linear direction. The linear direction of movement of the latch mount may be parallel with the mounting platform near the base mount.

In some embodiments, the mounting platform may define a recess for receiving at least a portion of the latch mount. The recess may be defined by a sidewall adapted for engagement with the latch mount in the extended position. The sidewall may block against movement of the latch mount beyond the extended position. In some embodiments, the latch mount may include an extension defining an engagement surface for engagement with the sidewall in the extended position.

According to another aspect of the present disclosure, a training system for transferring training force to at least one digit of a user for physical activity may include a mounting platform including a mounting body, an attachment system including a base mount secured with the mounting platform and a latch moveably engaged with the base mount and positionable between a retracted position and an extended position, and at least one hold feature including an engagement surface for engagement with at least one digit of the user's body for training. The at least one hold feature may be selectively attachable with the attachment system for securement with the mounting platform. The at least one hold feature may define a mount opening configured for receiving the attachment system therein. The mount opening may be formed in correspondence with the attachment system to block against removal of the attachment system from the mount opening when the latch is arranged in the extended position and to permit removal of the attachment system from the mount opening when the latch is arranged in the retracted position.

In some embodiments, the base mount and the latch may each define cleat surfaces angled towards the mounting platform. One cleat surface may be defined on an end of the base mount and the other cleat surface is defined on an end of the latch opposite to the end of the base mount.

In some embodiments, the mount opening of the hold feature may be defined by a pair of engagement walls. One of the pair of engagement walls may be arranged with corresponding angle to the cleat surface of one of the base mount and the latch. The other of the pair of engagement walls may be arranged with corresponding angle to the cleat surface of the other of the base mount and the latch.

In some embodiments, the latch may be moveable between the retracted and extended positions in a linear direction. The linear direction of movement of the latch may be parallel with the mounting platform near the base mount.

In some embodiments, the mounting platform may define a recess for receiving at least a portion of the latch. The recess may be defined by a sidewall adapted for engagement with the latch mount in the extended position. The sidewall may block against movement of the latch beyond the extended position.

In some embodiments, the latch may include an extension defining an engagement surface for engagement with the sidewall in the extended position. The extension may project from a body of the latch towards the mount platform and the engagement surface defines a step near the cleat surface of the latch. The step may be defined near an end of the cleat surface of the latch closest to the mount platform. The step may transition directly to the cleat surface at the center portion of the latch.

These and other features of the present disclosure will become more apparent from the following description of the illustrative embodiments.

BRIEF DESCRIPTION OF THE DRAWINGS

Some embodiments of the present disclosure are illustrated as an example and are not limited by the figures of the accompanying drawings, in which like references may indicate similar elements and in which.

DETAILED DESCRIPTION OF THE DRAWINGS

Figure 1:
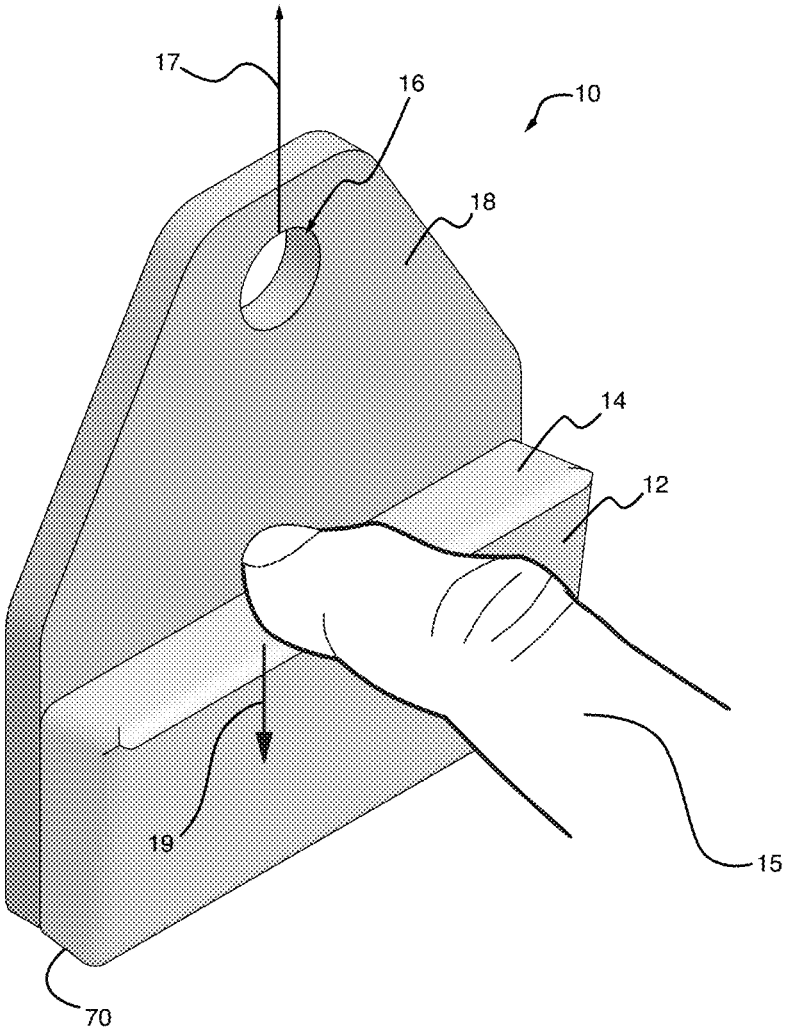
FIG. 1 is a perspective view of a finger training device having a mounting plate and a hold detachably secured to the mounting plate to provide an engagement platform (on an upper side) for engaging at least one finger of a user's hand for training.

For the purposes of promoting an understanding of the principles of the disclosure, reference will now be made to a number of illustrative embodiments illustrated in the drawings and specific language will be used to describe the same.

Activity specific training can provide targeted strength and/or conditioning complimentary to the tasks of the activity. Such specific training can permit maintenance and/or advancement towards activity related goals even outside the context of the activity itself. For example, adventure sports, such as climbing, may make use of specific terrain and/or equipment (such as natural or artificial climbing courses) that may be inconvenient to access on a frequent basis.

Providing sport specific training equipment can allow the user to train in related areas at more convenient times and/or places. Moreover, targeted training can maintain and/or increase the user's sport-specific talents. In the case of climbing, targeted finger strengthening and/or conditioning can maintain and/or increase the climber's grip strength, stamina, flexibility, and/or agility. Versatile training can broaden the scope of the targeted training benefits.

In the illustrative embodiment as shown in FIG. 1, a finger training device 10 can provide a selectively attachable hold feature 12 that forms a engagement surface (platform) 14 for engagement with one (or more) finger 15 of a user's hand to act against a load for training. The finger training device 10 illustratively includes a mounting platform 18 and a load feature 16 formed in the mounting platform 18 and embodied as a connection point for transfer of the load to the finger training device 10. The mounting platform 18 is illustratively embodied to have a body formed as a plate. The load can be provided by a cable resistance system, for example, from a plate loaded weight lifting system, against which the user can train her fingers to improve strength, endurance, etc. In the cable resistance system example, the load would be directed generally upward (in the orientation of FIG. 1) as indicated by arrow 17, while the user's finger 15 would apply a force generally downward (in the orientation of FIG. 1) as indicated by arrow 19 to work against the load. In some embodiments, the load may be embodied to include any suitable manner and/or arrangement of applied load to the load feature 16, for example but without limitation, gravity weights, band resistance, inertia resistance, and/or the like.

In the illustrative embodiment as shown in FIG. 1, the hold feature 12 is selectively secured with the mounting platform 18 to transfer load to the user's fingers. As discussed in additional detail below, the hold 12 is selectively detachable from the mounting platform 18 to permit the user's to change the type of engagement surface 14 for training. Simple and/or quick change of the engagement surface 14 can increase the versatility of the training and/or promote a compact training solution.

Figure 2:
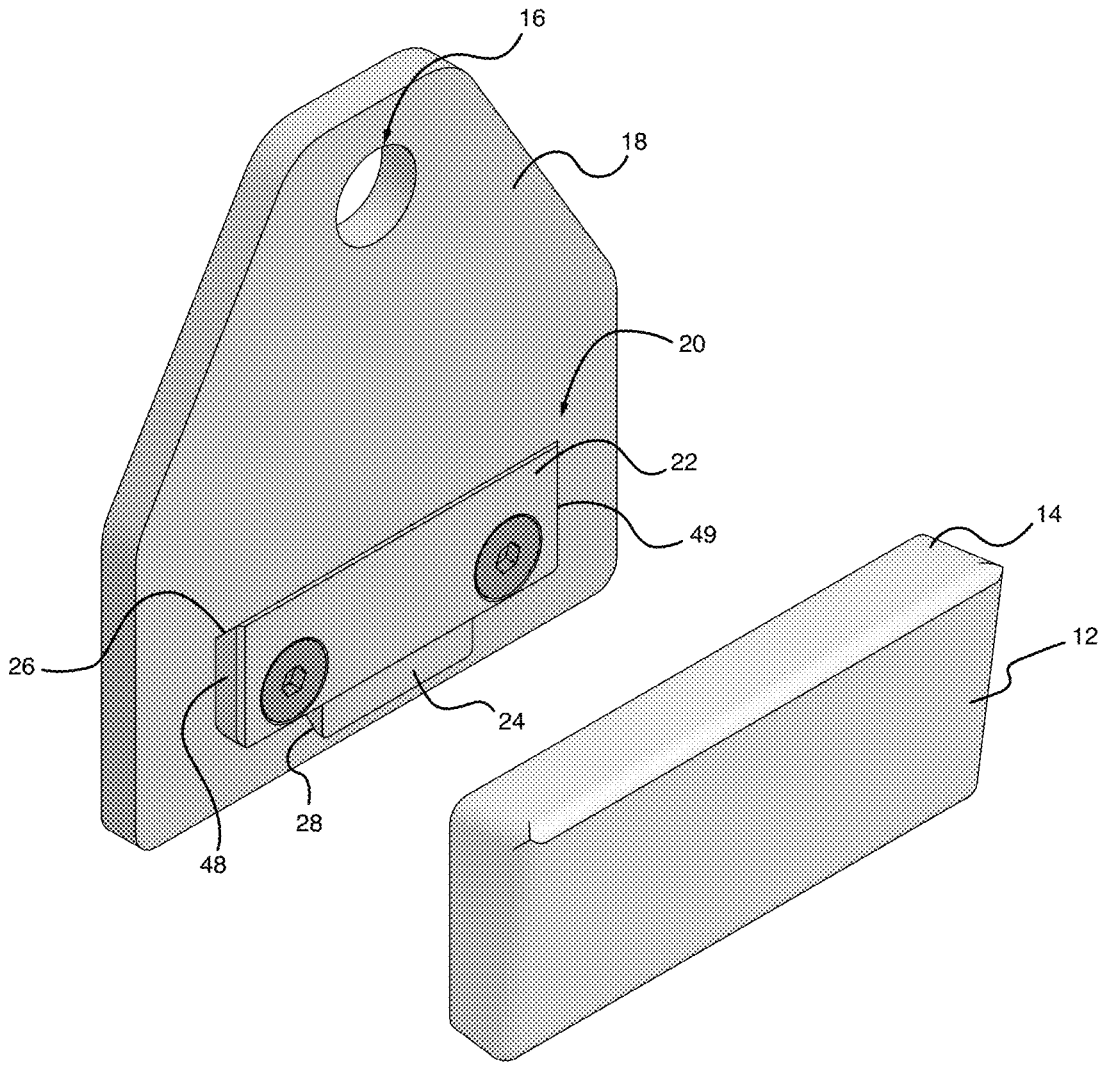
FIG. 2 is a perspective of the finger training device of FIG. 1 having the hold separated from the mounting plate to reveal an attachment system having a latch positionable between retracted and extended positions.

In the illustrative embodiment as shown in FIG. 2, the hold 12 has been detached from the mounting platform 18 to reveal an attachment system 20 for selective attachment (and detachment) of the hold 12 with the mounting platform 18. The attachment system 20 illustratively includes a base mount 22 secured with the mounting platform 18, and a retractable latch 24 for coordinated engagement with the hold 12 to selectively secure the hold 12 with the mounting platform 18. As discussed in additional detail below, each of the base mount 22 and the latch 24 include outer surfaces 26, 28, respectively, arranged counterpoised with each other to form complimentary engagement with the hold 12.

Figure 3:
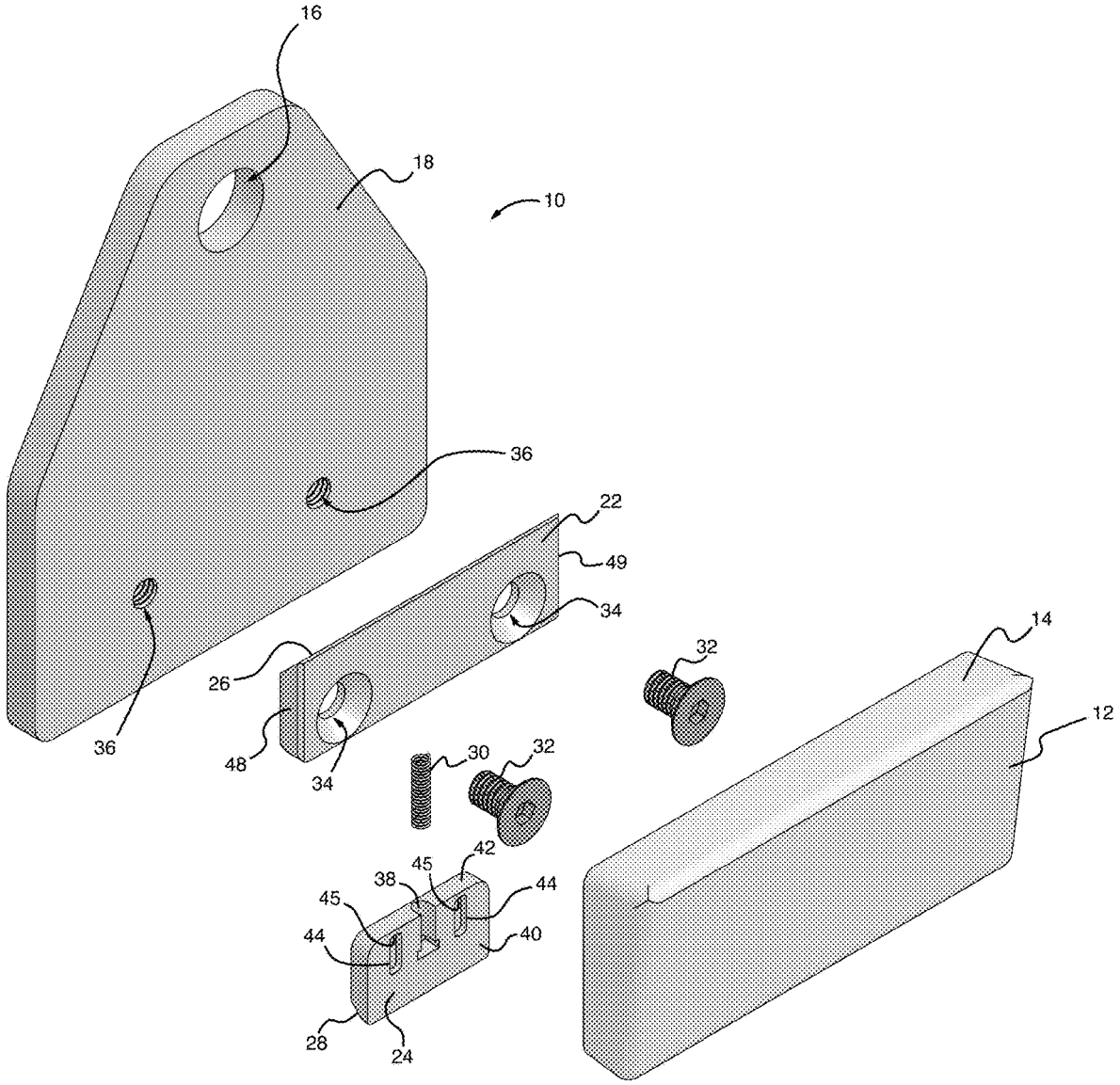
FIG. 3 is an exploded perspective view of the finger training device of FIG. 1.

As shown in FIG. 3, the attachment system 20 illustratively includes a biasing member, embodied as a spring 30 for biasing the latch 24 away from the base mount 22. The base mount 22 is illustratively secured with the mounting platform 18 by threaded fasteners 32 extending through mounting holes 34 of the base mount 22 to engage complimentary thread holes 36 of the mounting platform 18. The mounting holes 34 are illustratively countersunk holes to allow flush fitting of the heads of the fasteners 32 therein. In some embodiments, the base mount 22 may be secured with the mounting platform 18 by any suitable means, including but without limitation, fasteners, adhesive, weld, mechanical binding, and/or combinations thereof.

As shown in FIG. 3, the latch 24 illustratively includes a spring seat 38 defined therein for receiving a portion of the spring 30. The spring seat 38 is illustratively embodied as a gap recess formed complimentary with a longitudinal end of the spring 30 to receive an end of the spring 30 for biasing the latch 24 from the base mount 22. The spring seat 38 is illustratively open on a surface 42 of the latch 24 that faces the base mount 22 to permit the spring 30 to extend out from the spring seat 38 for engagement with the base mount 22. The spring seat 38 is illustratively open on a face 40 of the latch 24. The latch 24 illustratively includes a pair of tracks 44 defined on the face 40 for engagement with the hold 12 to limit the movement of the latch 24, as discussed in additional detail below. The tracks 44 each include an end wall 45 arranged on an upper end thereof (in the orientation of FIG. 3).

Figure 4:
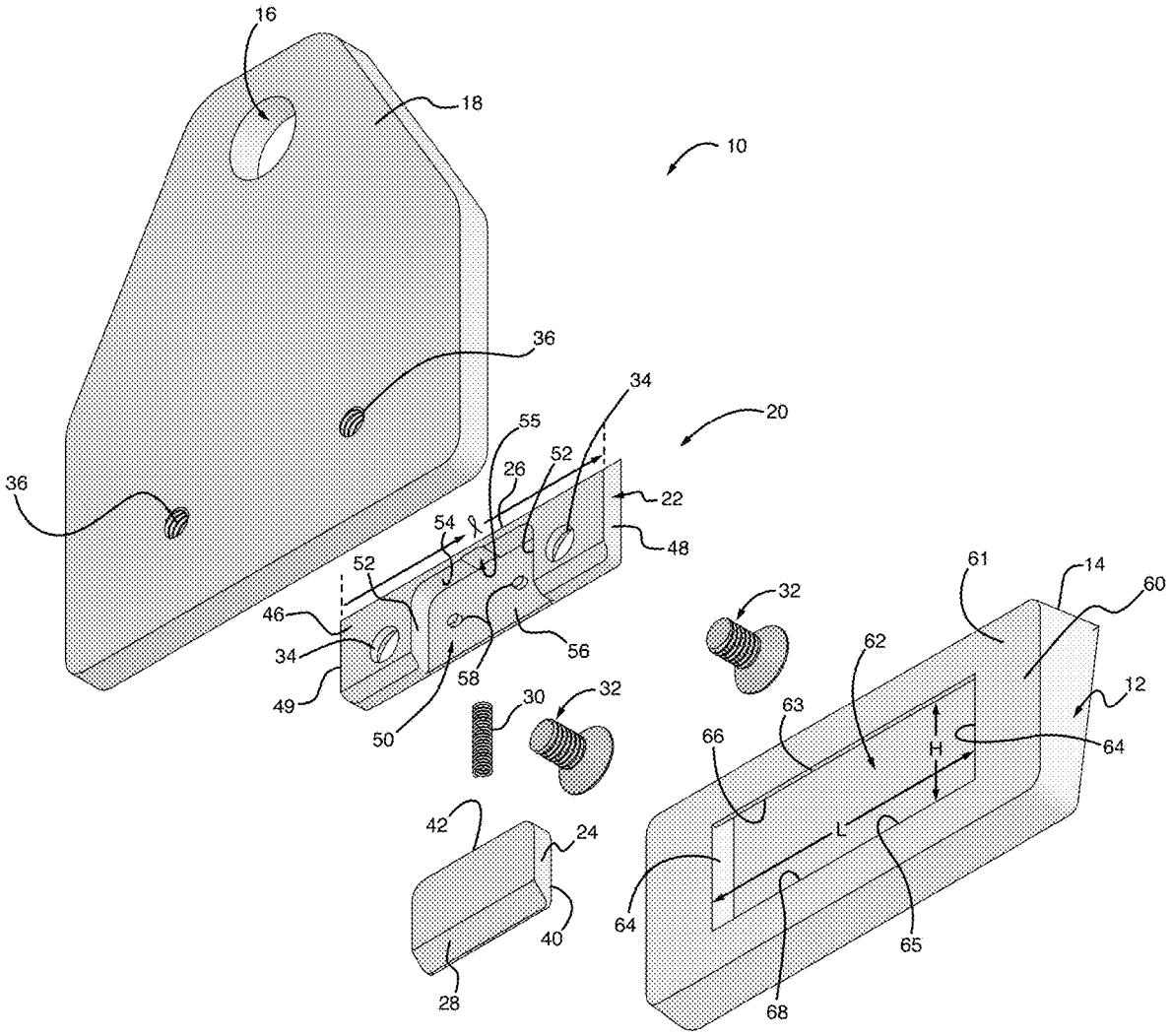
FIG. 4 is the exploded perspective view of the finger training device of FIG. 3 from a rear view.

As shown in FIG. 4, the base mount 22 illustratively includes a body 46 that defines the surface 26 as an inclined top surface (in the orientation of FIG. 4) and side surfaces 48,49. The body 46 defines a length 1 between its side surfaces 48,49. The body 46 of the base mount 22 illustratively includes a recess 50 defined therein for receiving the latch 24.

As shown in FIG. 4, the recess 50 is illustratively formed complimentary to the latch 24 to receive the latch 24 for translation for selective engagement with the hold 12. The recess 50 is illustratively defined by side walls 52, 54 and end wall 56 of base mount 22. The side walls 52 connect with the side wall 54 which illustratively includes rounded corners complimentary to the shape of the latch 24 at the lateral ends of surface 42. The side wall 54 illustratively includes a detent 55 formed therein to engage with an end of the spring 30. The end wall 56 illustratively includes a pair of pegs 58 projecting therefrom, each peg 58 formed complimentary to one of the pair of tracks 44 defined in the latch 24 for sliding engagement. The pegs 58 are illustratively received within the corresponding track 44 and can engage the corresponding end wall 45 of the track 44 to stop further translation of the latch 24 relative to the base mount 22, as discussed in additional detail below. In some embodiments, translation of the latch 24 may be limited by any suitable manner, for example, by any number, size, and/or shape of the pegs 58 and/or tracks 44. In some embodiments, one or more pegs 58 may be arranged on the latch 24 and corresponding tracks 44 may be formed on the body 46 in engagement with each other to limit the translation of the latch 24. The recess 50 illustratively includes a spring rest 55 for engagement with an end of the spring 30 to bias the latch 24 away from the base mount 22.

As shown in FIG. 4, the hold 12 illustratively includes a body 60 having a mount opening 62 defined therein for receiving the attachment system 20 for selective securement with the mounting platform 18. The mount opening 62 is illustratively defined in a surface 61 of the body 60 that faces the mounting platform 18 when the hold 12 is secured with the mounting platform 18. The mount opening 62 is illustratively defined by opposing sidewalls 64 and opposing engagement walls 66, 68.

As shown in FIG. 4, the sidewalls 64 of the mount opening 62 are illustratively spaced apart from each other to define a length L of the mount opening 62. The length L of the mount opening 62 is sized complimentary with the length 1 of the base mount 22 to maintain the relative lateral positions between the base mount 22 and the hold 12 when the attachment system 20 is received within the mount opening 62. The engagement walls 66,68 define a height H between peaks 63, 65 of the mount opening 62 at the surface 61 corresponding to allow reception of the attachment system 20 into the mount opening 62 when the attachment system 20 is arranged to have a retracted height (10 as discussed in additional detail below. As discussed in additional detail herein, the engagement walls 66,68 are illustratively embodied to define opposing sloped surfaces, having the peaks 63,65 formed as the portions of the engagement walls 66, 68 closest to each other.

Figure 5:
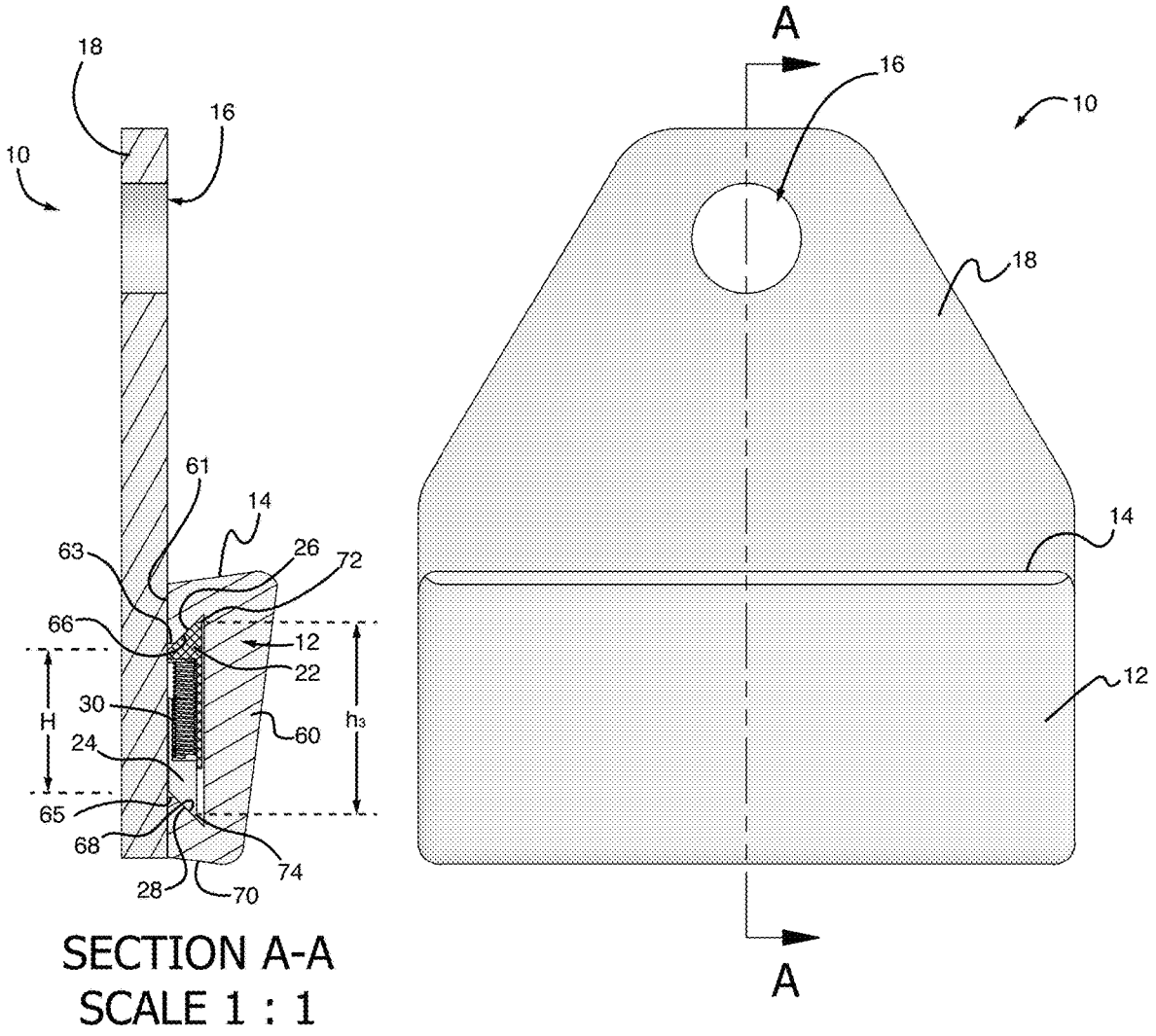
FIG. 5 is a front elevation view (right) of the finger training device of FIG. 1 and a cross-sectional view (left) taken along the line A-A.

As shown in FIG. 5, the hold 12 is secured with the mounting platform 18 by receiving the attachment system 20 within the mount opening 62 with the latch 24 in an extended position. The engagement walls 66, 68 of the hold 12 are formed complimentary with the attachment system 20 to permit selective securing of the hold 12 with the mounting platform 18 under movement of the latch 24. The engagement wall 66 selectively engages the surface 26 of the base mount 22, and the engagement wall 68 selectively engages the surface 28 of the latch 24, forming a height $h_3$ between peaks 72, 74 of the surfaces 26, 28 which corresponds with the arrangement of the engagements walls 66, 68 (discussed in additional detail herein). The engagement walls 66,68 have complimentary but opposing incline with their corresponding surfaces 26,28 to selectively secure the hold 12 with the mounting platform 18. Engagement wall 66 is illustratively formed to have an incline facing slightly downward (in the orientation of FIG. 5) and away from the mounting platform 18, while surface 26 is formed to have a complimentary opposing incline facing slightly upward (in the orientation of FIG. 5) and towards the mounting platform 18. Engagement wall 68 is illustratively formed to have an incline facing slightly upward (in the orientation of FIG. 5)

and away from the mounting platform 18, while surface 28 is formed to have a complimentary opposing incline facing slightly downward (in the orientation of FIG. 5) and towards the mounting platform 18. The inclination of the surfaces 26, 28 together with the inclination of the engagement walls 66, 68 can provide a wedge force to secure the hold 12 with the mounting platform 18.

In the illustrative embodiment, the incline of the engagement walls 66, 68 are equivalent to each other. With equivalent incline of the engagement walls 66, 68, the hold 12 can be secured to the mounting platform 18 with an alternative position such that a surface 70 faces generally upward (toward the load feature 16) and the surface 14 faces generally downward (in the orientation of FIG. 5). In the alternative position, by rotating the hold 12 by 180 degrees (about the horizontal in the orientation of the cross-section on the left hand portion of FIG. 5), the engagement wall 68 can engage with the surface 26 of the base mount 22 and the engagement wall 66 can engage with the surface 28 of the latch 24. In some embodiments, the incline of the engagement walls 66, 68 relative to each other may be different, although each complimentary to its corresponding surfaces 26,28.

Figure 6:
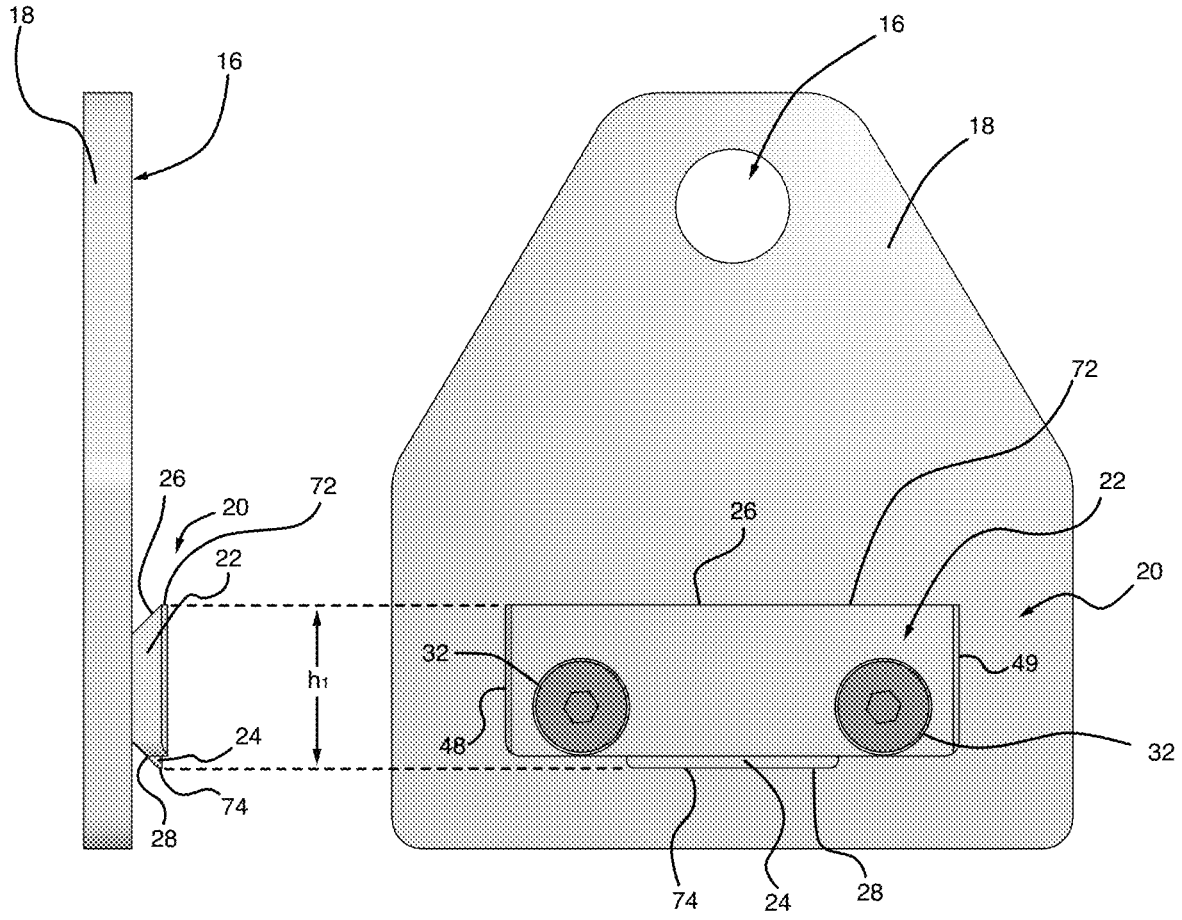
FIG. 6 is a front elevation view (right) of the finger training device of FIG. 1 and left side elevation view (right) showing the attachment system in a retracted position.
Figure 7:
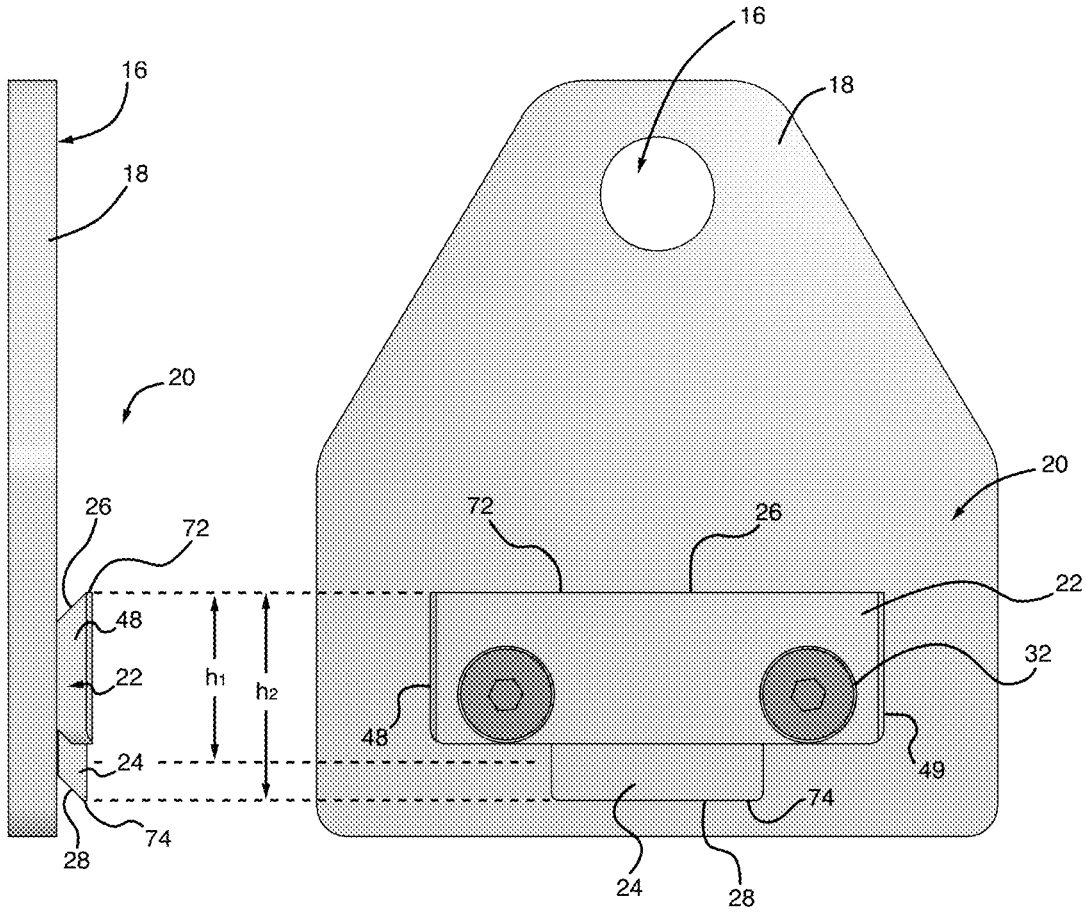
FIG. 7 the front elevation view (right) of the finger training device of FIG. 6 and left side elevation view (right) showing the attachment system in a extended position.

As shown in FIG. 6, the latch 24 is arranged in a retracted position such that the attachment system 20 defines a height $h_1$, as a retracted height. The height $h_1$ is illustratively defined as the distance between the peaks 72, 74 as the farthest points of each surface 26, 28 from each other. At the height $h_1$, the attachment system 20 can be pivoted into (or out of) engagement with the mount opening 62 of the hold 12. As shown in FIG. 7, the latch 24 is arranged in an extended position such that the attachment system 20 defines a height $h_2$, as an extended height. At the height h 2, the attachment system 20 cannot pass through the height H between the peaks 63, 65 of the mount opening 62, and thus, the attachment system 20 cannot be disengaged out of (or reengaged into) the mount opening 62 without depressing the latch 24 to the retracted position.

Figure 8:
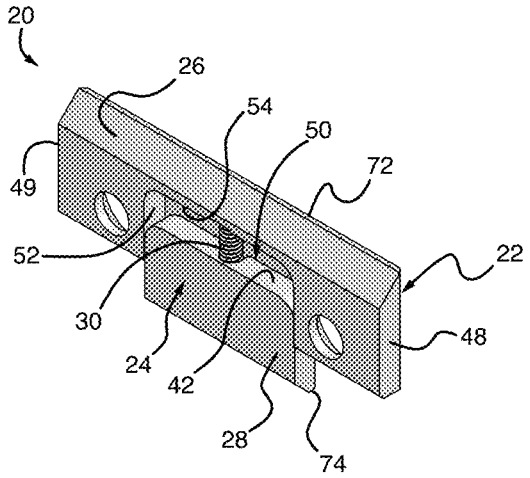
FIG. 8 is a rear perspective view of the attachment system of the finger training device of FIG. 2 in isolation.

As shown in FIG. 8, the attachment system 20 is shown in isolation having the extended height $h_2$. The latch 24 is in the extended position under the biasing force of the spring 30 to drive the surface 42 of the latch 24 and side wall 54 of the base mount 22 away from each other.

Figure 9:
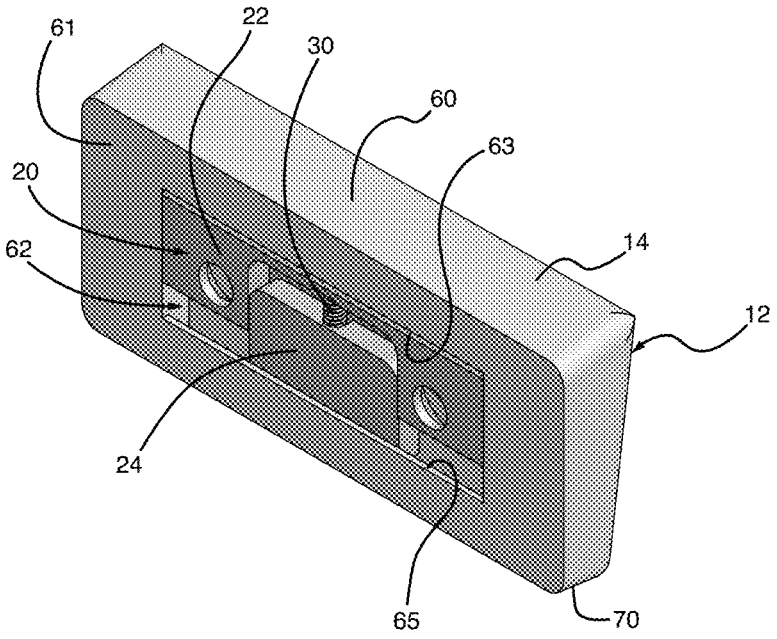
FIG. 9 is a rear perspective view of the attachment system and hold of the finger training device of FIG. 2 in isolation.

As shown in FIG. 9, the hold 12 is secured with the attachment system 20. The attachment system 20 is illustratively received within the mount opening 62 having the extended height $h_3$, such that the latch 24 is in an extended position. The extended height $h_3$ is illustratively embodied to be distance slightly smaller than the height $h_2$ in order to allow a positive biasing force between the attachment system 20 and hold 12, when the engagement walls 66,68 engage the corresponding surfaces 26,26, although in some embodiments, the heights $h_2$ and $h_3$ may be equal to each other. The correspondence between the attachment system 20 and the mount opening 62 blocks against removal of the attachment system 20 from the mounting open 62 when the attachment system 20 is in an extended position. The correspondence in shape and size between the attachment system 20 and the mount opening 62 provide a snug fit with little or no play when the attachment system 20 is extended while received within the mount opening 62. As reviewed above regarding FIG. 5, the engagement walls 66,68 are engaged with the surfaces 26, 28 to prevent removal of the attachment system 20 from the mount opening 62.

Figure 10:
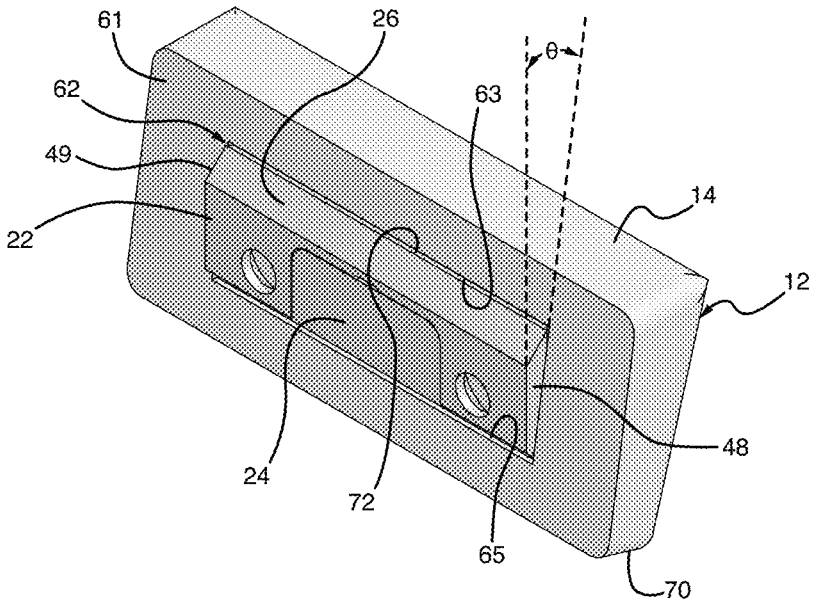
FIG. 10 is a rear perspective view of the attachment system and hold of the finger training device of FIG. 2 in isolation showing that the latch has been retracted and the hold is pivoted to partial remove the hold from the attachment system.

As shown in FIG. 10, the attachment system 20 has been changed to have the retracted height $h_1$ to demonstrate detachment of the hold 12. In the illustrative example, the hold 12 has been pressed upward relative to the attachment system 20 to position the latch 24 in the retracted position such that the attachment system 20 has the retracted height $h_1$. While the latch 24 remains at least partly engaged with the engagement wall 68 to maintain the retracted position, the hold 12 can be pivoted relative to the attachment system 20 (indicated by the angle θ between the surface 61 and the base mount 22) to move the peak 72 of the base mount 22 out from the mount opening 62 to disengage the surface 26 from the engagement wall 66, releasing the hold 12 from the attachment system 20. Once the peak 72 is clear from the mount opening 62, the latch 24 need not remain retracted and can be allowed to extend under the bias of the spring 30. The attachment system 20 can now be removed entirely from the mount opening 62.

Reattachment of the hold 12 with the attachment system 20 is illustratively achieved in reverse of the detachment maneuver discussed above. Namely, the latch 24 can be inserted into the mount opening 62 in at least partial engagement with the engagement wall 68. The latch 24 is moved into the retracted position by relative movement between the hold 12 and the attachment system 20 to achieve the retracted height $h_1$. The attachment system 20 having the retracted height $h_1$ can be pivoted such that the peak 72 enters the mount opening 62. Upon entrance of each of the peaks 72, 74 into the mount opening 62, the force to compress the latch 24 into the retracted position can be released to engage the surfaces 26, 28 with the engagement walls 66, 68.

Although the detachment and reattachment maneuvers have been described in terms of movement of the hold 12, the corresponding relative movement of the attachment system 20 would equally achieve detachment and reattachment. Moreover, under rotation of the hold 12 to have the surface 70 directed upward (closer to the load feature 16), the hold 12 can be secured with the attachment system 20 in generally the same manner with the surfaces 26 and 28 now engaging/disengaging with the engagement walls 68 and 66, respectively. Although depicted with the mounting platform 18 omitted for descriptive purposes, the same or similar maneuvers would be undertaken with the attachment system 20 secured with the mounting platform 18.

Accordingly, the ease in maneuvering the device 10 for detachment and reattachment of the hold 12 can provide an easily adaptable training platform. For example, as the user can easily switch between orientation of the surfaces 14 and 70 facing generally upward (closer to the load feature 16) to engage the selected surface 14, 70 to work against the load. In the illustrative embodiment, the surface 70 is shallower and has a different pitch than the surface 14. The different arrangements of the surfaces 14, 70 provide different training conditions for the user's fingers.

Moreover, the hold 12 is merely one possible hold having surfaces 14, 70. Other types of holds having the same or similar mount opening 62 can be secured with the attachment system 20. For example, suitable holds may include holds having a mount opening 62 as disclosed herein but having any of the exterior contouring as those holds disclosed within U.S. patent application Ser. No. 15/807,427, the contents of which are incorporated herein by reference, including at least those portions directed to system, devices, and/or methods for finger training and/or hold features. Accordingly, the user can safely switch the type of hold secured with the mounting platform 18 with ease and/or without removable parts that may be misplaced. The user can vary the type of hold during a training session or otherwise without the need for tools.

In the illustrative embodiment, the finger training device 10 is formed of metal components, but in some embodiments, the device 10 may be formed of any suitable materials include polymers.

Figure 11:
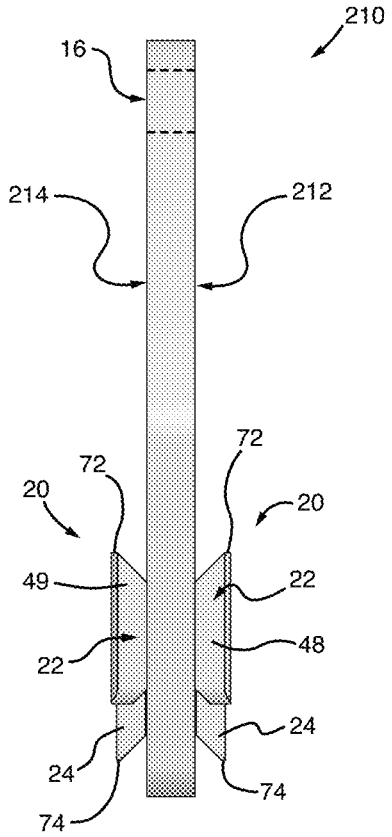
FIG. 11 is a side elevation view of another embodiment of a finger training device similar to the device of FIG. 1 but having a pair of attachment systems on opposite sides of the mounting platform.

In the illustrative embodiment as shown in FIG. 11, another embodiment of a finger training device 210 may include selective attachment of various holds, for example, hold 12. The finger training device 210 is similar to the finger training device 10, and the disclosure of finger training device 10 applies equally to the finger training device 210, except in instances of conflict with the specific disclosure of finger training device 210. The finger training device 210 includes a mounting platform 18 and a pair of attachment systems 20. One of the attachment systems 20 is secured with the mounting platform 18 on a first side 212 and the other attachment system 20 is secured with the mounting platform 18 on a second side 214, opposite the first side 212. Each attachment system 20 can be selectively secured with a hold. Accordingly, a pair of holds can be secured with the mounting platform 18 simultaneously. The user can port and use the finger training device 210 with up to two holds secured thereto, providing flexibility for training, while reducing the number of loose parts.

Figure 12:
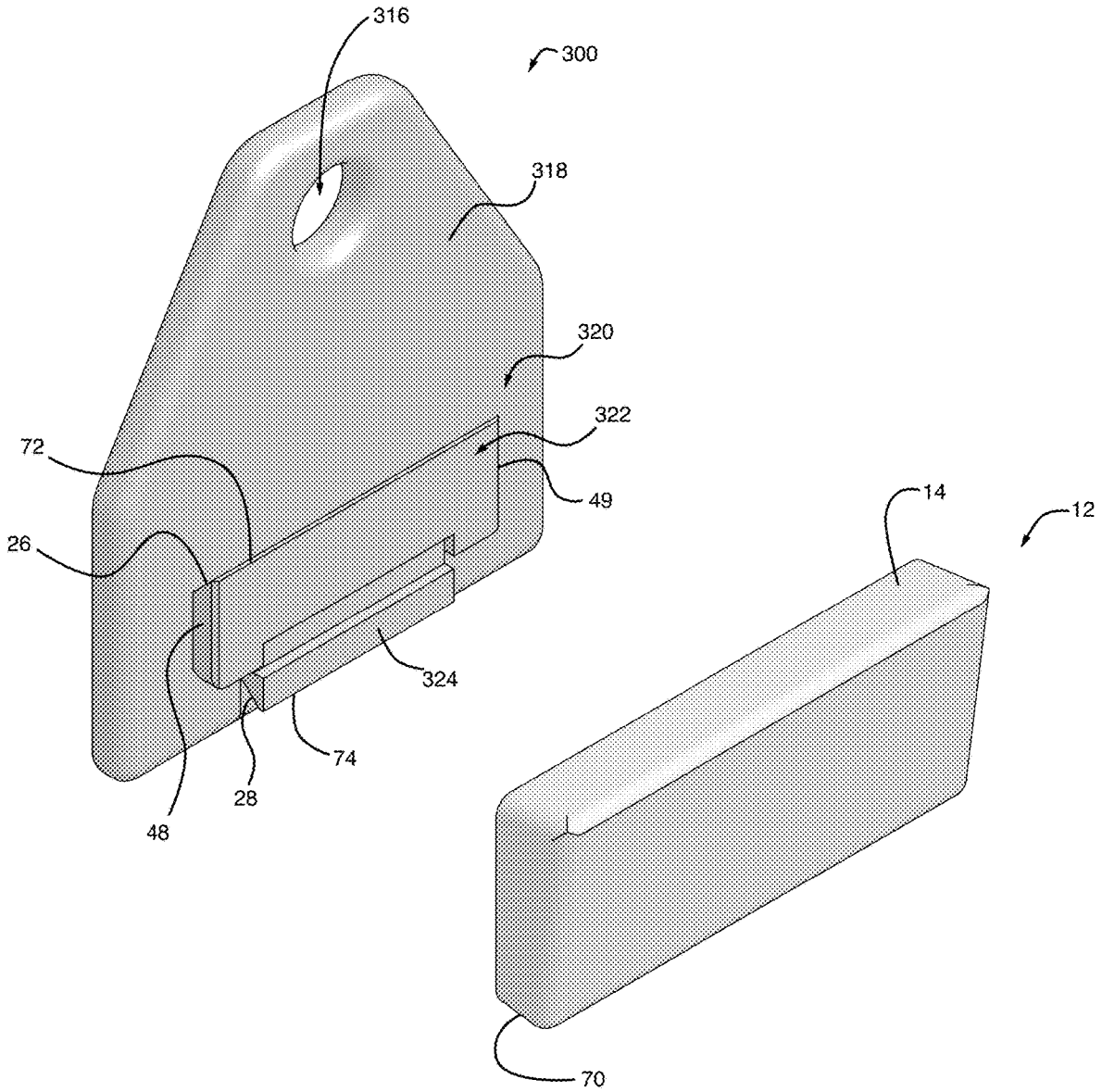
FIG. 12 is a perspective view of another embodiment of a finger training device having a hold separated from an attachment system that is mounted on a mounting platform.

In the illustrative embodiment as shown in FIG. 12, another embodiment of a finger training device 300 is shown. The finger training device 300 is similar to the finger training devices 10, 210 and the disclosure of finger training devices 10, 210 apply equally to the finger training device 300, except in instances of conflict with the specific disclosure of finger training device 300.

Figure 13:
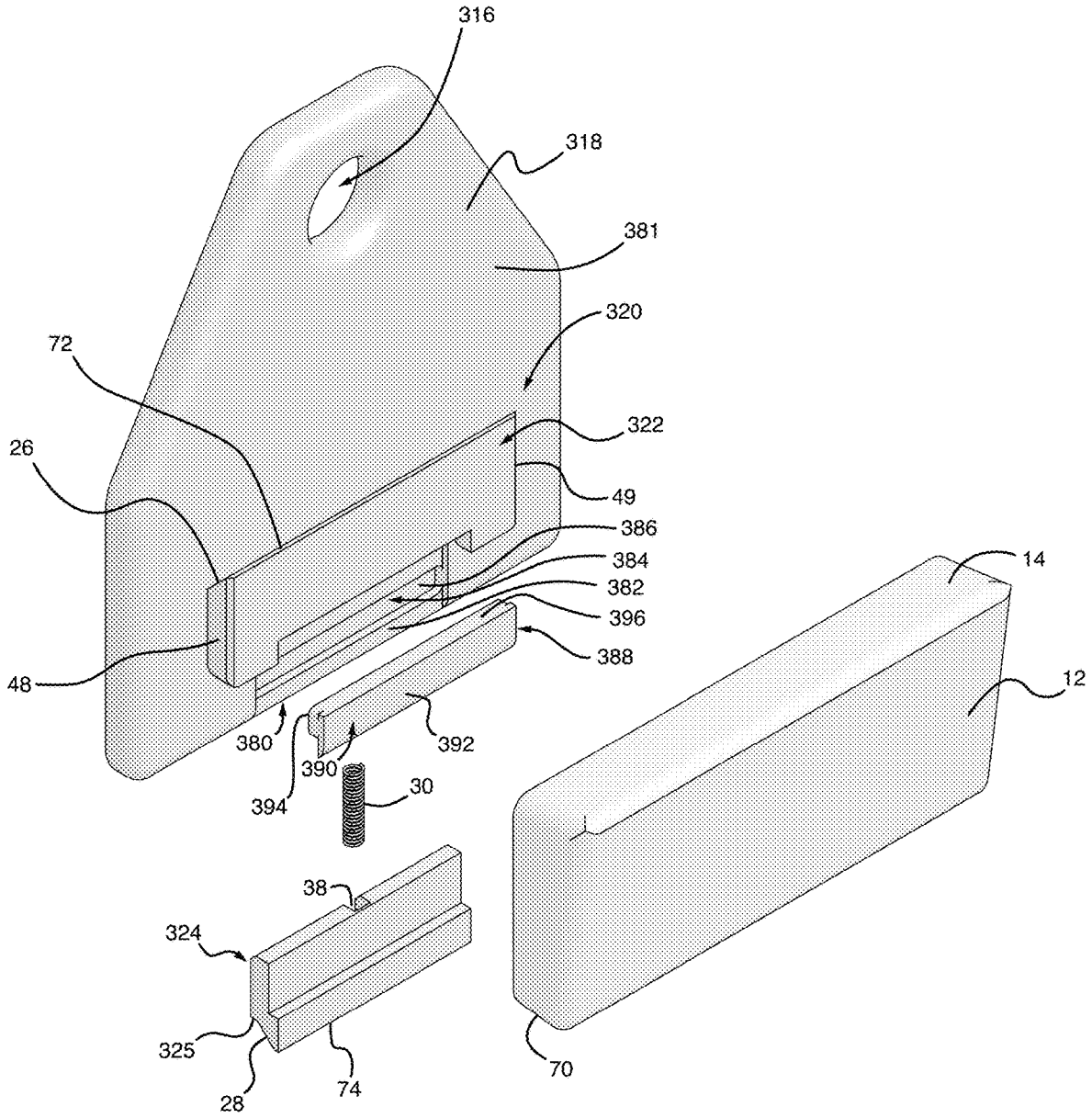
FIG. 13 is an exploded perspective view of the finger training device of FIG. 12.

The finger training device 300 illustratively includes a mounting platform 318 and attachment system 320 secured to the mounting platform 318 for selective attachment of the hold 12. The attachment system 320 illustratively includes a base mount 322 secured with the mounting platform 318 and a latch 324 positionable between retracted and extended positions to achieve respective retracted and extended heights $h_1$ and $h_2$ (and $h_3$). The base mount 322 is illustratively formed as an integral portion of the mounting platform 318, but in some embodiments, may be formed separately and secured with the mounting platform 318 in any suitable manner. The latch 324 illustratively includes an end surface 325 (as shown in FIG. 13) for contact with a stopper 388 in the extended position ($h_2$) to limit further movement. The attachment system 320 engages the hold 12 by insertion within the mount opening 62 as discussed above regarding earlier embodiments.

As shown in FIG. 13, the mounting platform 318 illustratively includes a recess 380 defined in a front surface 381 of the platform 318 for receiving a portion of the attachment system 320. The recess 380 illustratively includes a shallow section 382 and a depression 384 having a rear wall 386 that penetrates deeper into the surface 381 than the shallow section 382. The attachment system 320 illustratively includes a stopper 388 formed complimentary with the recess 380 for reception therein to provide an end stop for movement of the latch 324.

The stopper 388 illustratively includes a shallow portion 390 having a front surface 392 and an extension 394 projecting from the shallow portion 390. The shallow portion 390 and the extension 394 are each formed complimentary to the shallow section 382 and depression 384, respectively, such that when received within their complimentary part of the recess 380, the front surface 392 is coplanar with the surface 381. The stopper 388 illustratively defines a stopper surface 396 for engagement with the end surface 325 of the latch 324 in the extended position ($h_2$) to limit further movement.

Figure 14:
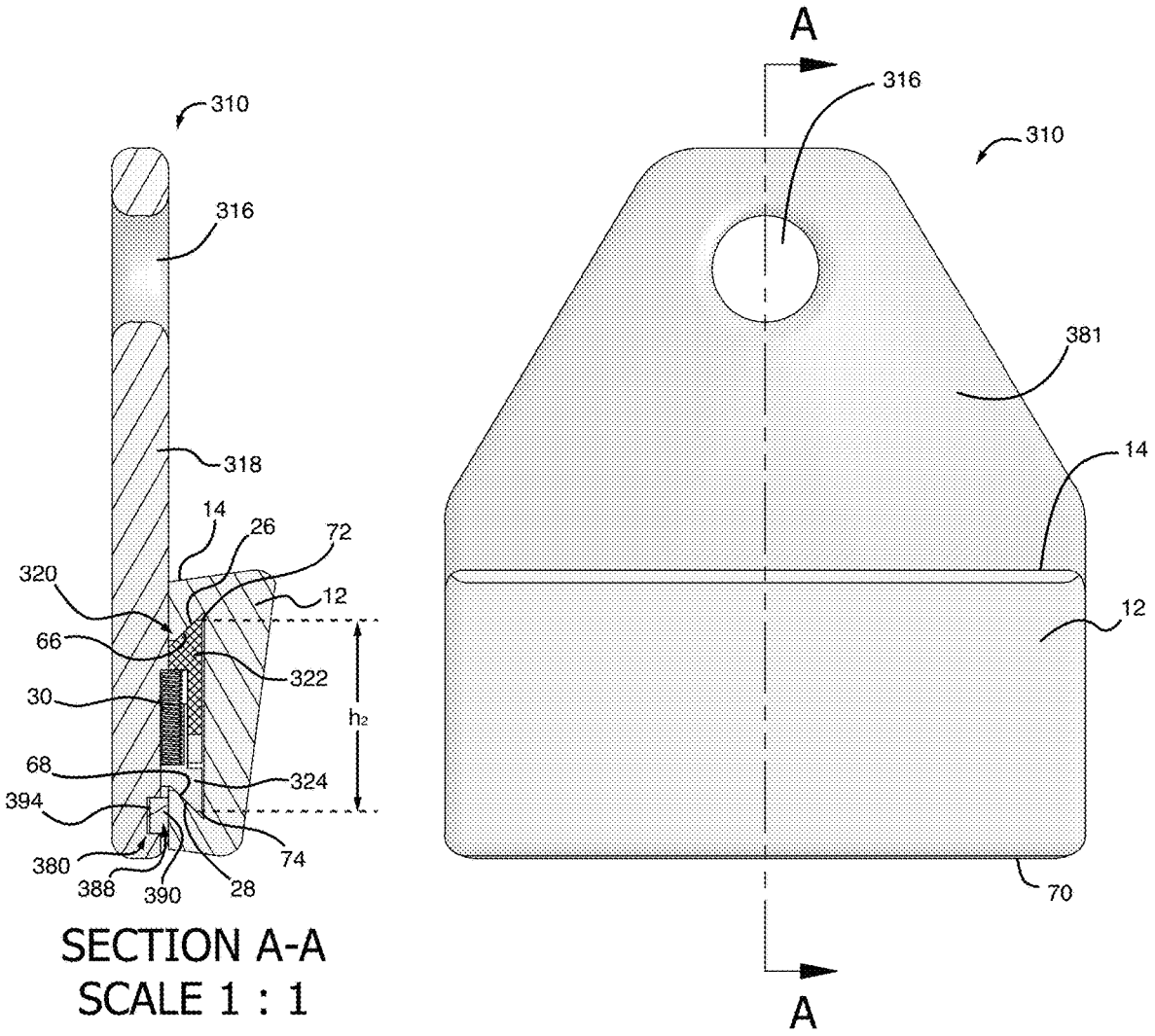
FIG. 14 is a front elevation view (right) of the finger training device of FIG. 12 and a cross-sectional view (left) taken along the line A-A.

As shown in FIG. 14, the hold 12 is secured with the attachment system 320 with the latch 324 in an extended position ($h_2$). The stopper 388 is received within the recess **38*o* and the surface 68 of hold 12 is engaged with surface 28 of the latch 324 to prevent further (downward) movement, forming the height $h_2$ between peaks 72, 74. In the illustrative embodiment, the latch 324 engages each of the stopper 388 and the engagement surface 68 when the attachment system 320 is seated within the mount opening 62 and the attachment system 320 defines the height $h_2$ (i.e., the heights $h_2$ and $h_3$ would be equal to each other), but in some embodiments, the surface 396 may be slightly out of engagement with the latch 324 when the attachment system 320 is seated within the mount opening 62 and the attachment system 320 is extended to define the height $h_3$ (i.e., height $h_3$ is slightly shorter than $h_2$) to apply a biasing force between the attachment system 320 and at least one of the engagement surfaces 66,68. The hold 12 can be detached from the attachment system 320 by sliding the hold 12 upward relative to the base mount 322 to move the latch 324 into the retracted position and pivoting the hold 12 relative to the base mount 322** as discussed above regarding earlier embodiments.

Figure 15A:
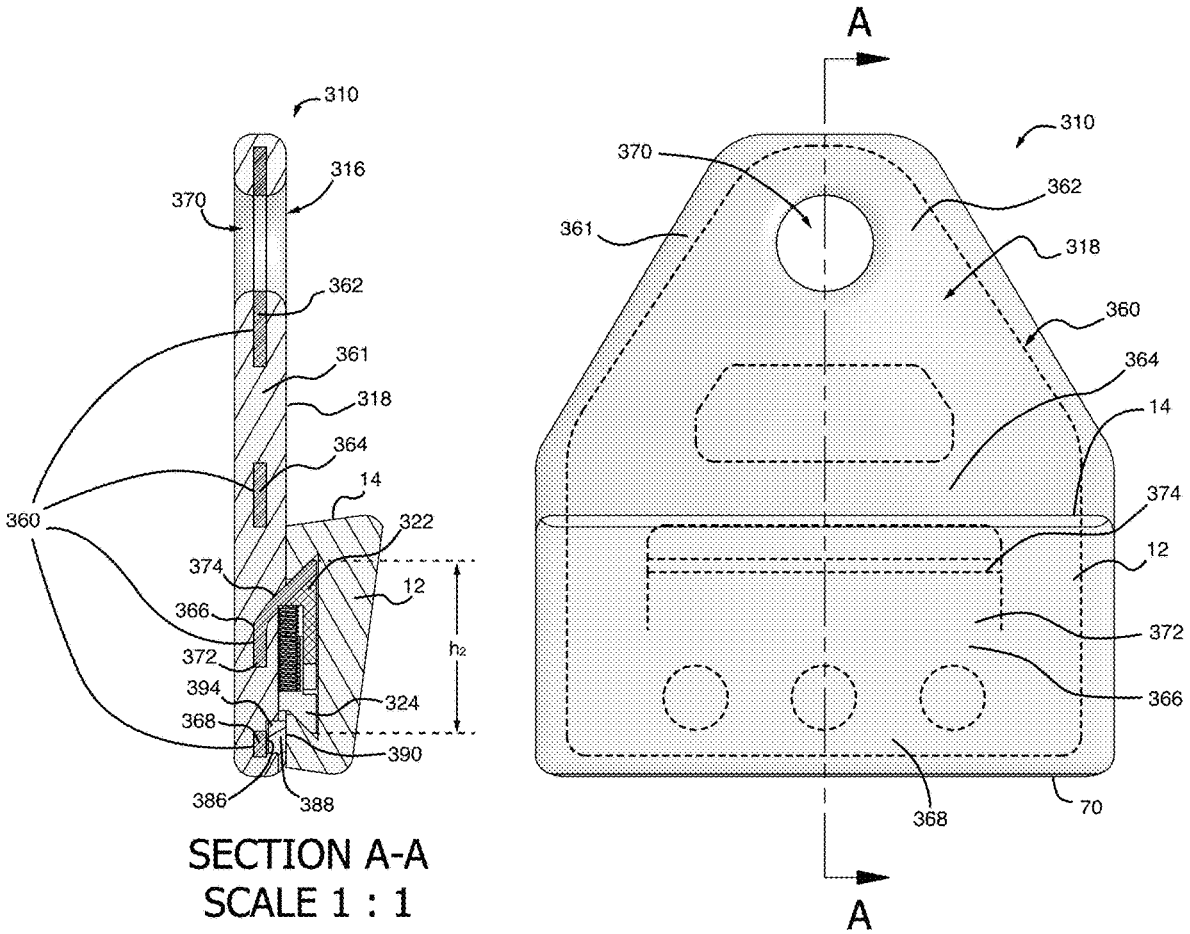
FIG. 15A is a front elevation view (right) of the finger training device of FIG. 12 and a cross-sectional view (left) taken along the line A-A showing that an embedded frame is formed within the body of the mounting platform.

Referring to FIG. 15A, the mounting platform 318 illustratively includes a frame 360 and a body 361 in which the frame 360 is embedded. The frame 360 illustratively includes load section 362 arranged near the load feature 316, a mid-section 364 arranged near the middle of the mounting platform 318, a cleat section 366 for engagement with the base mount 322, and a stopper section 368 for engagement with the stopper 388. The frame 360 provides an internal reinforcement to the mounting platform 318. The body 361 of the mounting platform 318 is illustratively formed of a polymer having the frame 360 as a metal reinforcement structure, although in some embodiments, the body 361 and/or the frame 360 may be formed of any suitable materials. The base mount 322 is illustratively formed as integral with the body 361 and internally supported by the cleat section 366. In some embodiments, the frame 360 may be omitted and the mounting platform 318 may be formed as a single unitary structure.

The sections 362,364,366,368 of the frame 360 are illustratively formed of uniform thickness as shown in their cross-section in FIG. 15A. The load section 362 is illustratively arranged near the load feature 316 and includes a hole 370 complimentary to the load feature 316 to receive and transfer load. In some embodiments, the portions of the frame 360 defining the hole 370 may be exposed within the load feature 316 to make direct contact with loads applied thereto. The mid-section 364 is illustratively arranged between the cleat section 366 and the load section 362. The cleat section 366 illustratively includes a base 372 and an arm 374 extending from the base 372 to engage with the base mount 322. The stopper section 368 illustratively forms the rear wall 386 of the depression 384 for engagement with the stopper 388. According, a reinforced mounting platform can provide a lightweight yet durable form of finger training device.

Figure 15B:
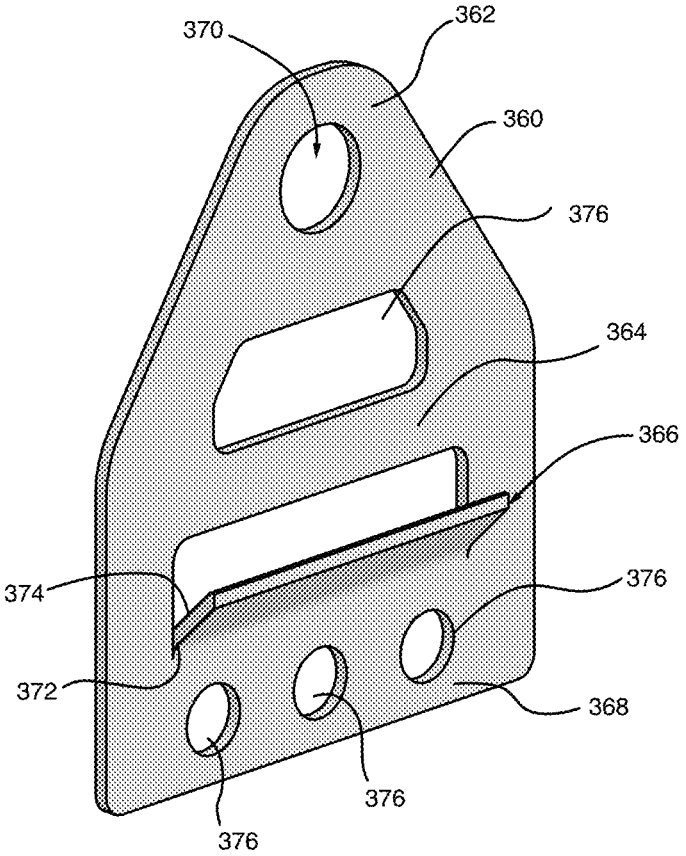
FIG. 15B is a perspective view of the frame in isolation.

As shown in FIG. 15B, the frame 360 is shown in isolation to illustrate that it is embodied as an integrated sheet or plate having the cleat section 366 extending outwardly. The frame 360 illustratively includes a number of holes 376 defined therethrough. The holes 376 are illustratively distributed evenly along the horizontal dimension of the frame 360. The cleat section 366 is illustratively formed as a bent section sliced from the sheet and projecting outwardly from the sheet.

Figure 16:
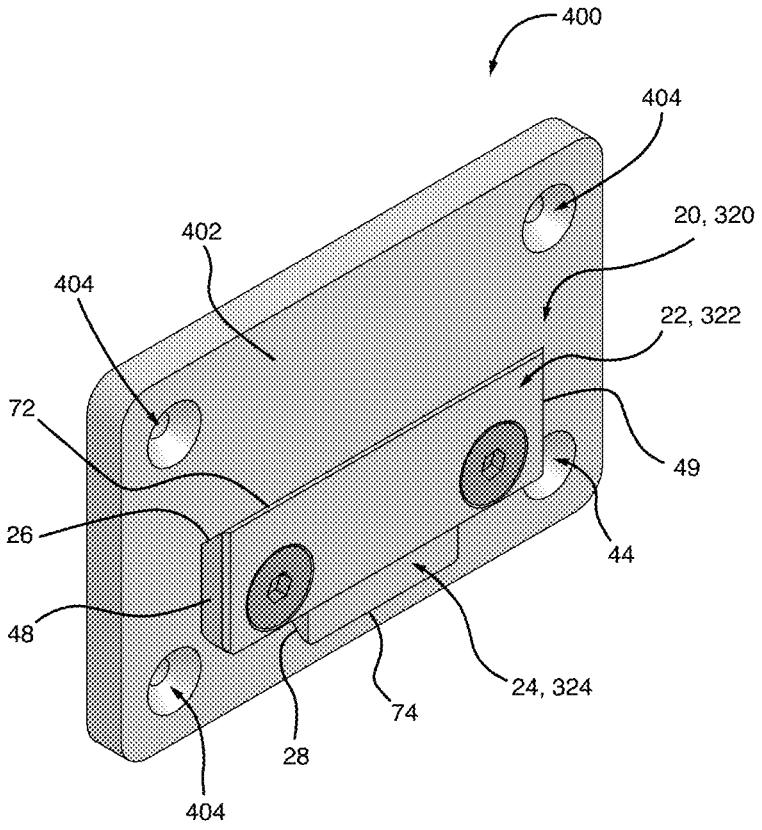
FIG. 16 is a perspective view of another embodiment of a finger training device including a mounting board formed as the mounting platform having an attachment system secured with the mounting board to receive selective connection of hold features.

As shown in FIG. 16, another embodiment of a finger training device 400 includes a mounting plate 402 for stationary mounting to a wall or board, for example, by fasteners extending through holes 404. The mounting plate 402 can replace the mounting platform 18, 318 of earlier embodiments. The mounting plate 402 illustratively includes an attachment system 20,320 secured thereto to receive selective engagement of a hold having the mount opening 62, such as hold 12. The finger training device 400 can provide a stationary and/or more permanently placed training platform.

Figure 17:
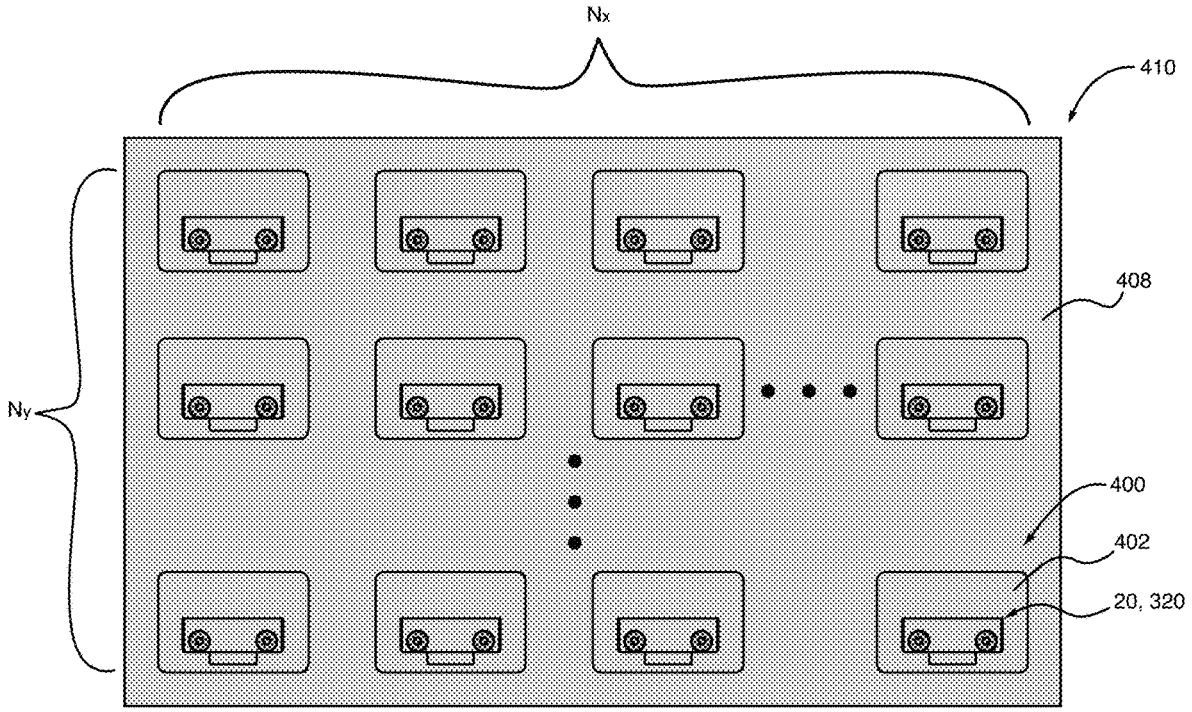
FIG. 17 is a plan view of an arrangement of a number of the finger training devices of FIG. 16 each arranged on a training board to form a customizable training system.

As shown in FIG. 17, a number of the finger training devices 400 can be mounted to a training board 408 to create a training system 410. The training board 408 can be secured to a wall for climbing training and/or use in any suitable manner for applied load to one or more of a user's fingers. Each finger training device 400 can receive attachment of a hold feature to customize the training system 410. As indicated by the ellipses, the number of finger training devices 400 in each of the horizontal and vertical directions can vary. In the illustrative embodiment, the training devices 400 are evenly spaced across the training board 408, but in some embodiments, the training devices 400 may be arranged in any suitable pattern for training. In some embodiments, the mounting plate 402 may be omitted and the base mount 22, 322 can be mounted directly to the training board 408.

Figure 18:
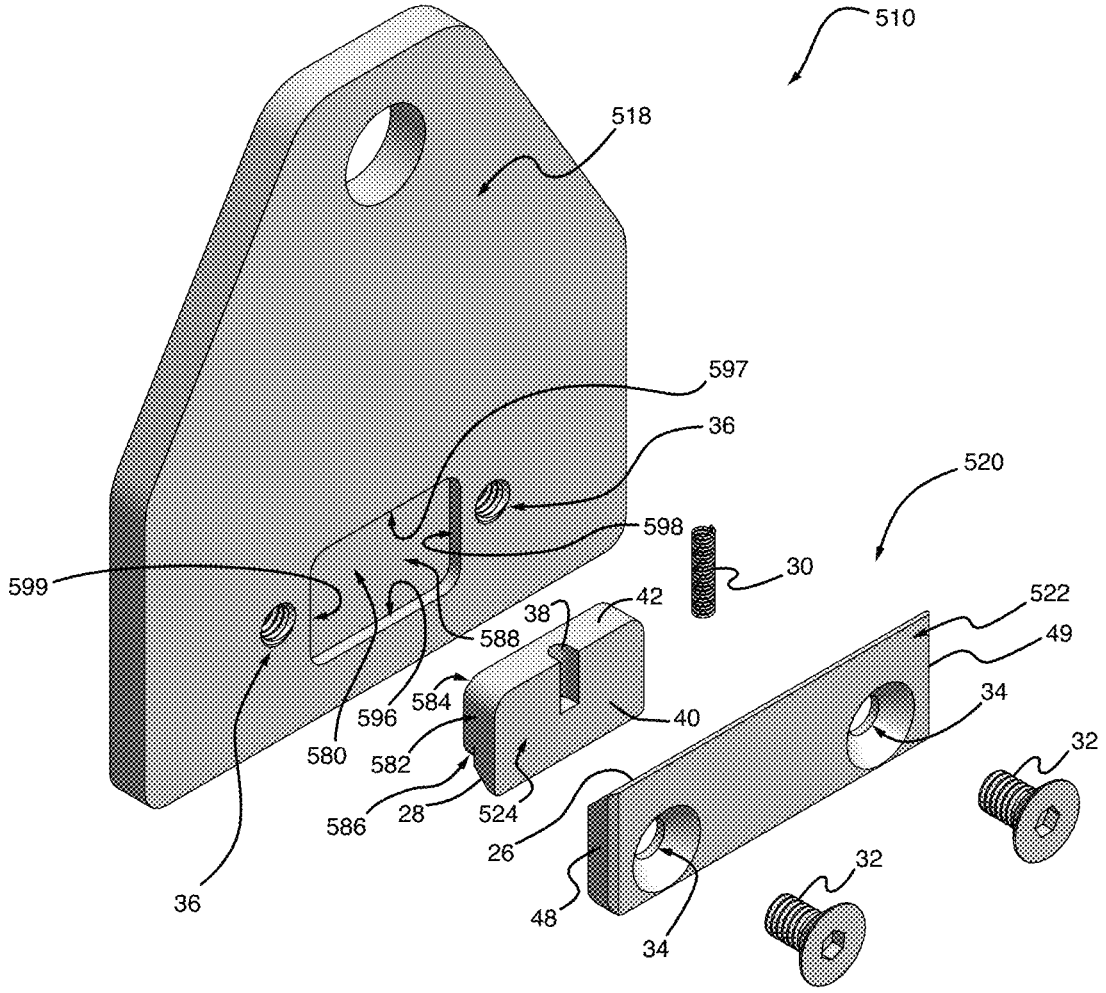
FIG. 18 is an exploded perspective view of another finger training device similar to FIGS. 1-7 but including a recess within the mounting plate for engagement with the attachment system.
Figure 19:
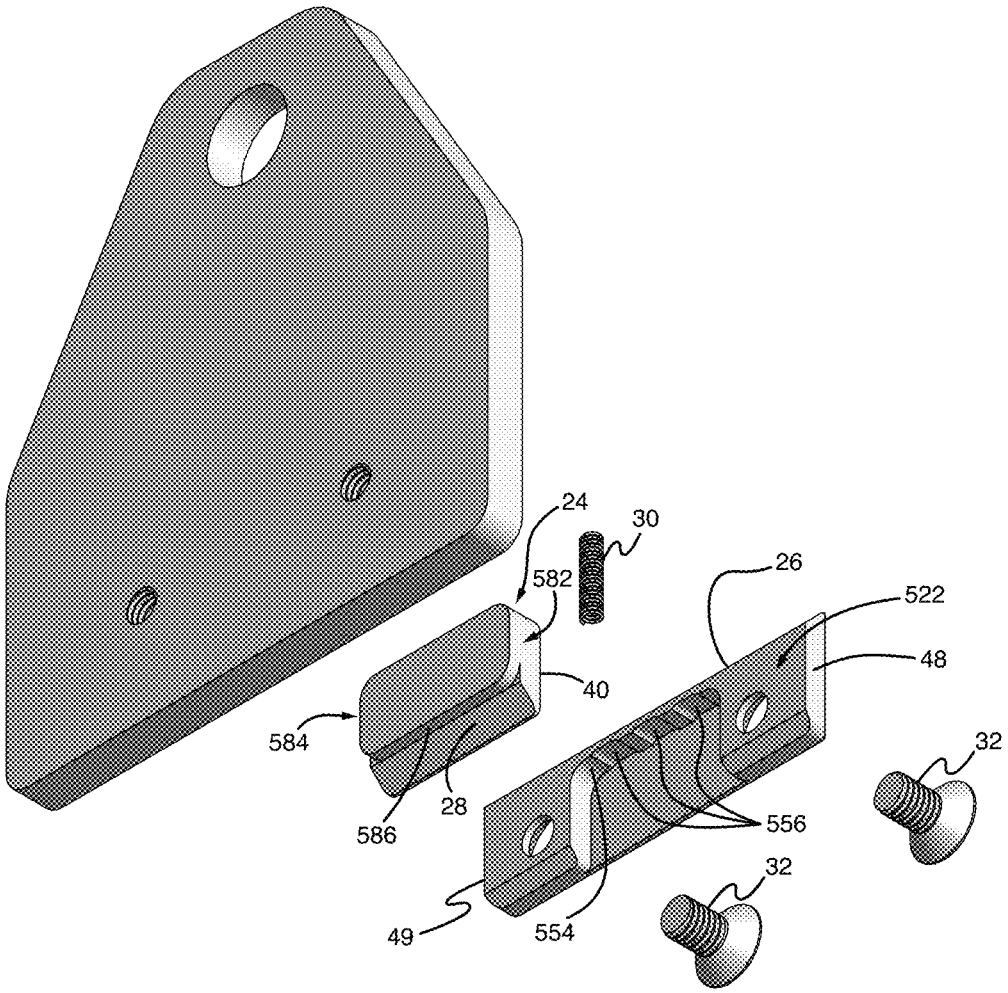
FIG. 19 is the exploded perspective view of the finger training device of FIG. 18 from a rear view.

Referring now to FIG. 18, another illustrative finger training device 510 is shown for engagement with a hold feature. The finger training device 510 is similar to the finger training devices 10, 210, 300, 400, and the disclosure of the finger training devices 10, 210, 300, 400 is applicable to the finger training device 510, except in instances of conflict with the particular disclosure of finger training device 510. The finger training device 510 illustratively includes a mounting platform 518 having an attachment system 520 for selective attachment (and detachment) of a hold feature with the mounting platform 518. The attachment system 520 illustratively includes a base mount 522 secured with the mounting platform 518 and a retractable latch 524 for coordinated engagement with the hold feature to selectively secure the hold feature with the mounting platform 518. As discussed in additional detail below, each of the base mount 522 and the latch 524 include the outer surfaces 26, 28 arranged counterpoised with each other to form complimentary engagement with the hold feature 12. The side wall 554 (as shown in FIG. 19) of the base mount 522 illustratively includes a number of detents 556 formed therein, a central one of the detents 556 formed to engage with an end of the spring 30.

Unlike the finger training devices 10, 210, 300, 400, the finger training device 510 includes a cavity 580 which can engage with the latch 524. The latch 524 includes a latch body 582 defining the face 40 and an extension 584 projecting from the body 582 opposite to the face 40. The extension 584 defines a lower surface 586 that is formed opposite to the surface 42. The extension 584 is arranged within the cavity 580 to support motion of the latch 524.

The cavity 580 is defined by a back surface 588, and side surfaces 596, 597, 598, and 599. The cavity 580 is sized to receive extension 584 such that the distance between surfaces 598 and 599 is approximately the width of extension 584 but slightly larger to relieve friction. The distance between surfaces 596 and 597 is illustratively larger than the distance between surfaces 42 and 586 on latch 524 by an amount required to allow for translation of the latch 524 as a difference between the two distances. As such, in the retracted position, translation of the latch 524 is blocked in one direction (upward movement of the latch 524 in the orientation of FIG. 18) by engagement of surface 42 of latch 524 with surface 597 of cavity 580, corresponding with the retracted height $h_1$. In the extended position, translation of the latch 524 is blocked in the other direction (downward movement of the latch 524 in the orientation of FIG. 18) by engagement of surface 586 of latch 524 with the surface 596 of cavity 580, corresponding with the extended height $h_2$. In embodiments, in which the attachment system 520 defines a height $h_3$ (slight smaller than $h_2$) when engaged within the hold feature to apply a positive biasing force, the surfaces 586, 596 would remain slightly disengaged with each other while the surfaces 26, 28 of the attachment system 520 engage the surfaces 66,68 of the hold feature.

The present disclosure includes hold features having the mount opening 62 for engagement (selectively) with the attachment systems. However, the hold features are not limited to the geometries of the hold 12 for engagement with the user's fingers (i.e., not limited to the surfaces 14, 70), nor to any specific so-called "crimp" hold feature geometries, and is in fact intended to encompass any hold feature geometry of any type; that is to say, a feature of any geometrical shape that can be grasped by the user in the utilization of the device. In the practice of climbing, there are known a plethora of different types of holds categorized by their general shape. These include, but are not limited to, jugs, mini-jugs, pockets, slopers, pinches, incuts, chips, edges, side pulls, underclings, gastons, and others known in the art of climbing. The incorporation of these and other hold types are within the scope of the present disclosure.

The present disclosure includes holds having mount openings 62 for receiving attachment systems therein for selective securement. In some embodiments, the attachment systems may be formed on the hold features and the mounting platforms may define mount openings 62 for receiving the attachment systems therein. In illustrative embodiments, the angled surfaces of the base mount and latch are oriented in correspondence with the mount platform (i.e., vertically and in correspondence to the forces 17, 19), however, in some embodiments, the angled surfaces of the base mount and latch may be oriented out of correspondence with the mount platform (e.g., orthogonal to the forces 17, 19 or in any suitable angle relative to the vertical), and in such embodiments the direction of travel of the latch between the retracted and extended positions may be oriented equally out of correspondence with the mount platform (e.g., orthogonal to the forces 17, 19 or in any suitable angle relative to the vertical). In illustrative embodiments, the outer surfaces 26, 28 are equivalent to each other (i.e., have the same degree of angularity relative to vertical), but in some embodiments, may differ from each other. Each of the outer surfaces 26, 28 is illustratively formed to have angularity from the vertical within the range of about 5 degrees to about 70 degrees.

In the illustrative embodiment, the pegs 58 are received within the corresponding track 44 and can engage the corresponding end wall 45 of the track 44 to stop further translation of the latch 24 relative to the base mount 22. The engagement of the pegs 58 with the end walls 45 illustratively corresponds to the engagement of the surfaces 26,28 and 66,68. Yet, in some embodiments, in order to establish biased engagement of the surfaces 26,28 with the engagement surfaces 68,66 of the hold 12, the end walls 45 may be illustratively arranged beyond the reach of the pegs 58 when the latch 24 is in the extended position to have the extended height $h_3$, slightly smaller than height $h_2$, and the pegs 58 may engage the end walls 45 when the latch 24 is in the extended position to define the height $h_2$.

Conventional devices may assist in the development and training of the fingers of the hand. Of particular interest is the finger strength and/or stamina that is desirable to cling to and remain suspended from very small features of the structure, which provide only a very small surface area onto which the fingers of the climber can make supportive physical contact. It is generally the case of such features that the depth (width) is less than the length of the distal phalanges of an average human beings' finger, and the length of such features such that all, few, or only one finger may be accommodated. In the practice of rock climbing, for instance, such features are known colloquially as "crimp" holds, which generally describes any hold that cannot accommodate a grasp beyond the first knuckle of the climber's fingers. More generally, a "hold" is anything that can be grasped by a climber as a means of support.

In the practice of climbing, and rock climbing in particular, it can be of great interest to strengthen the muscles attached to the digits, such as fingers and/or toes, so that the digits have sufficient strength to allow the climber to cling and remain suspended from a climbing structure using these small "crimp" like holds. Accomplishing this kind of finger training in conventional fitness settings, such as a common gym, presents challenges because the equipment, facilities, practices, and techniques of conventional strength training that involve the hands often employ large and/or full hand grips, wherein much of the full length of the fingers is used to grasp the relevant auxiliary of the equipment in use. Moreover, specific orientation of the engagement between the fingers and the grip can be overlooked. As such, generally speaking, conventional gym equipment can fail to provide adequate utility towards strengthening the fingers, for example, where it is desirable to train using less than a full grip and/or to use less than one knuckle length of merely one or a few fingers.

The present disclosure includes a movable latch that is positionable between retracted and extended positions. In illustrative embodiments, peaks 72,74 of the engagement surfaces 26, 28 of the attachment system 20, 320, 520 define heights $h_1$ and $h_2$ in the retracted and extended positions, respectively, and the height H between the peaks 63,65 of the surfaces 66,68 of the mount opening 62 of the hold feature is equal to the height $h_2$ (with tolerance for insertion of the attachment system into the mount opening, while in the retracted position) for selective connection with the attachment system 20. In illustrative embodiments, the fully extended position of the attachment system to a height $h_2$ is achieved to seat the attachment system within the mount opening 62. The optional definition of a height $h_3$ of the attachment system to seat the attachment system within the mount opening 62 to apply a biasing force between the attachment system and the hold, applies equally to the various embodiments disclosed herein.

The present disclosure includes a movable latch that is positionable between retracted and extended positions. In illustrative embodiments, peaks 72,74 of the engagement surfaces 26, 28 of the attachment system 20, 320, 520 define heights $h_1$ and $h_2$ in the retracted and extended positions, respectively, and the height H between the peaks 63,65 of the surfaces 66,68 of the mount opening 62 of the hold 12. Additionally, in some embodiments, peaks 72,74 of the engagement surfaces 26, 28 of the attachment system 20, 320, 520 define height $h_3$ as the height of the latch while the attachment system 20, 320, 520 is seated in the mount opening 62 of the hold feature, and surfaces 26, 28 are engaged with the corresponding surfaces 66, 68. In some embodiments, H and $h_1$ can be chosen such that H is equal to or greater than the minimum value that allows the mount opening 62 of the hold feature to receive and extract attachment system 20, 320, 520, while the latch 24 is in the fully retracted position to define $h_1$. In some embodiments, $h_2$ and $h_3$ are chosen such that latch 24 may provide positive bias of contact force between at least one of the surfaces 26, 28 and the corresponding surface 66,68 through biasing member 30 while the attachment system 20, 320, 520 is seated in mount opening 62 of the hold feature. Further, in some embodiments H can be less than $h_1$, $h_1$ can be less than $h_3$, and/or $h_3$ can be less than $h_2$. In some embodiments, examples values may be equal to or approximately equal to H=21.0 mm, $h_1$=21.5 mm, $h_2$=27.4 mm, and $h_3$=26.3 mm.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the scope and/or spirit thereof. Therefore, it is intended that the disclosure not be limited to the particular embodiments disclosed as the best mode contemplated for carrying out this disclosure, but that the disclosure will include all embodiments falling within the scope and/or spirit thereof.

What is claimed is:

1. A finger training device for transferring training force to at least one finger of a user for physical activity, the device comprising:

a mounting platform including a mounting body, and an attachment system including:

a base mount secured with the mounting platform and defining a first cleat surface, and a latch mount positionable between a retracted position and an extended position for selectively securing with training instruments, the latch mount defining a second cleat surface spaced apart from the first cleat surface, wherein in the extended position a first distance is defined between the first cleat surface and the second cleat surface, and in the retracted position a second distance is defined between the first cleat surface and the second cleat surface, the first distance being greater than the second distance.

2. The finger training device of claim 1, wherein the first cleat surface is angled towards the mounting platform.

3. The finger training device of claim 1, wherein the second cleat surface is angled towards the mounting platform.

4. The finger training device of claim 1, wherein the first cleat surface is defined on an end of the base mount and the second cleat surface is defined on an end of the latch mount opposite to the end of the base mount.

5. The finger training device of claim 1, wherein the latch mount is moveable between the retracted and extended positions in a linear direction.

6. The finger training device of claim 5, wherein the linear direction of movement of the latch mount is parallel with the mounting platform near the base mount.

7. The finger training device of claim 1, wherein the mounting platform defines a recess for receiving at least a portion of the latch mount.

8. The finger training device of claim 7, wherein the recess is defined by a sidewall adapted for engagement with the latch mount in the extended position.

9. The finger training device of claim 8, wherein the sidewall blocks against movement of the latch mount beyond the extended position.

10. The finger training device of claim 8, wherein the latch mount includes an extension defining an engagement surface for engagement with the sidewall in the extended position.

11. A training system for transferring training force to at least one digit of a user for physical activity, the system comprising:

a mounting platform including a mounting body, an attachment system including a base mount secured with the mounting platform and a latch moveably engaged with the base mount and positionable between a retracted position and an extended position, and at least one hold feature including an engagement surface for engagement with at least one digit of the user's body for training, the at least one hold feature selectively attachable with the attachment system for securement with the mounting platform, the at least one hold feature defining a mount opening configured for receiving the attachment system therein, the mount opening formed in correspondence with the attachment system to block against removal of the attachment system from the mount opening when the latch is arranged in the extended position and to permit removal of the attachment system from the mount opening when the latch is arranged in the retracted position.

12. The training system of claim 11, wherein the base mount and the latch each define cleat surfaces angled towards the mounting platform.

13. The training system of claim 12, wherein one cleat surface is defined on an end of the base mount and the other cleat surface is defined on an end of the latch opposite to the end of the base mount.

14. The training system of claim 12, wherein the mount opening of the hold feature is defined by a pair of engagement walls, wherein one of the pair of engagement walls is arranged with corresponding angle to the cleat surface of one of the base mount and the latch, and the other of the pair of engagement walls is arranged with corresponding angle to the cleat surface of the other of the base mount and the latch.

15. The training system of claim 11, wherein the latch is moveable between the retracted and extended positions in a linear direction.

16. The training system of claim 15, wherein the linear direction of movement of the latch is parallel with the mounting platform near the base mount.

17. The training system of claim 11, wherein the mounting platform defines a recess for receiving at least a portion of the latch.

18. The training system of claim 17, wherein the recess is defined by a sidewall adapted for engagement with the latch in the extended position.

19. The training system of claim 18, wherein the sidewall blocks against movement of the latch beyond the extended position.

20. The training system of claim 18, wherein the latch includes an extension defining an engagement surface for engagement with the sidewall in the extended position.

* * * * *